United States Patent [19]

Burrows

[11] Patent Number: 5,005,651

[45] Date of Patent: Apr. 9, 1991

[54] DOWNHOLE PUMP UNSEATING APPARATUS AND METHOD

[76] Inventor: Marvin L. Burrows, 125 W. St. Ann, Hobbs, N. Mex. 88240

[21] Appl. No.: 425,251

[22] Filed: Oct. 20, 1989

[51] Int. Cl.[5] ..... E21B 43/00; F04B 47/00

[52] U.S. Cl. ..... 166/381; 166/68; 166/109; 417/450

[58] Field of Search ..... 166/301, 381, 109, 178, 166/333, 105, 68; 417/448, 449, 450

[56] References Cited

U.S. PATENT DOCUMENTS

| | | | |
|---|---|---|---|
| 1,488,662 | 4/1924 | Cater | 166/301 |
| 1,698,797 | 1/1929 | Howe | 417/448 |
| 1,783,615 | 12/1930 | Gunn et al. | 417/448 |
| 1,950,328 | 3/1934 | Scohy et al. . | |
| 1,983,489 | 12/1934 | Penrod . | |
| 2,414,254 | 1/1947 | Busby | 417/450 X |
| 2,501,237 | 3/1950 | Sanders | 417/450 |
| 2,526,086 | 10/1950 | Sanders | 417/450 |
| 2,590,245 | 3/1952 | Harbison | 417/448 |
| 2,641,197 | 6/1953 | Stone | 417/450 |
| 2,982,355 | 5/1961 | Rodgers | 166/178 X |
| 4,087,212 | 5/1978 | Holder | 417/444 |
| 4,776,401 | 10/1988 | Dollison | 166/369 |

*Primary Examiner*—William P. Neuder

*Attorney, Agent, or Firm*—Marcus L. Bates

[57] ABSTRACT

A fluid producing well has a downhole pump assembly located at a lower end of a tubing string for producing fluid from a pay zone. Some parts of the pump are affixed to a hold-down and the hold-down is telescopingly received in sealed relationship within a seating nipple. The seating nipple is connected to the tubing string. The hold-down and the pump assembly are connected to an apparatus in the form of a telescoping sleeve assembly by which the hold-down can be pushed uphole from a location that is below the seating nipple and forced to become unseated from the seating nipple. The apparatus includes an adaptor affixed at the lower end of the hold-down that extends downhole below the seating nipple. The telescoping apparatus is connected to engage the borehole and apply an uphole force on the adaptor in response to the tubing being lowered downhole. This action unseats the hold-down from the seating nipple, and pushes the pump uphole with a force that is equal to the weight of the tubing string that is supported from the lower end of the borehole.

20 Claims, 3 Drawing Sheets

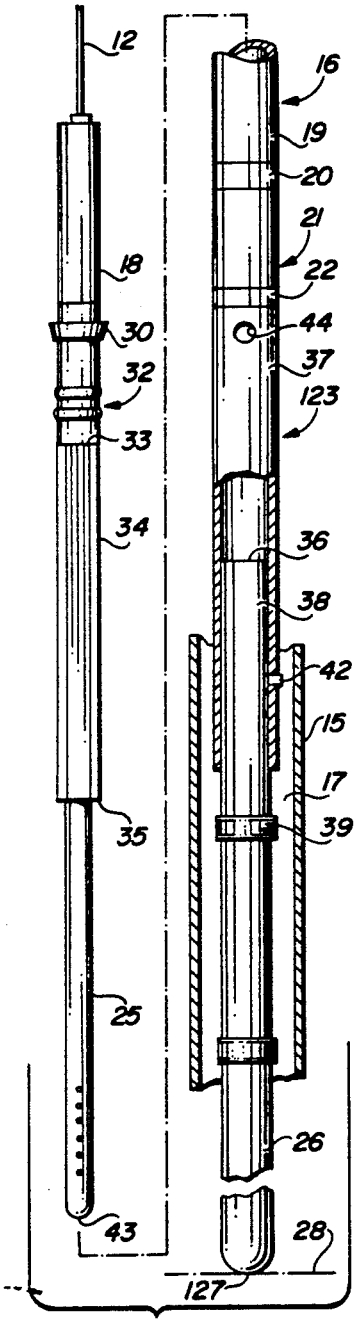
FIG. 4
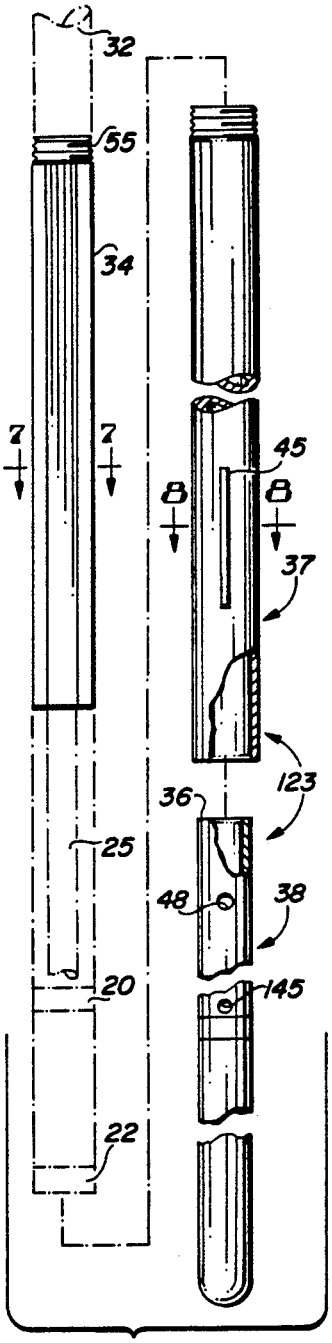
FIG. 6
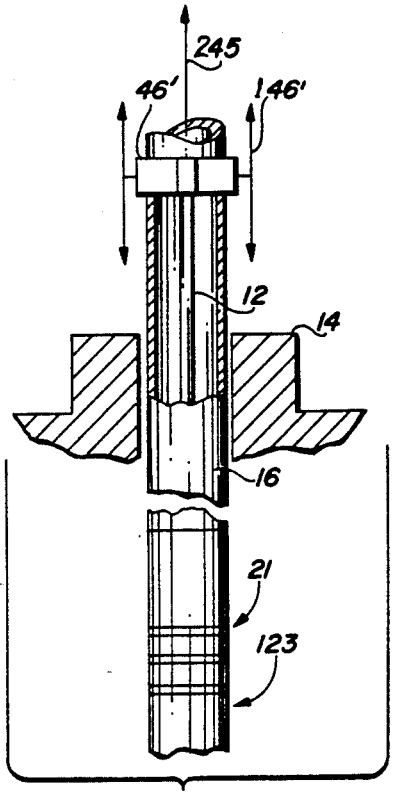
FIG. 5
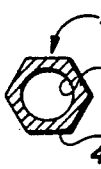
FIG. 7
FIG. 8
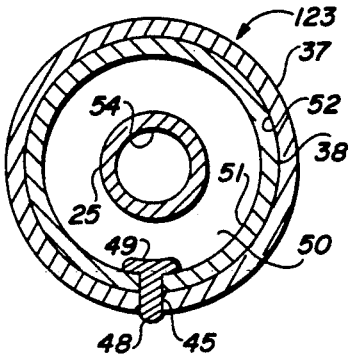

DOWNHOLE PUMP UNSEATING APPARATUS AND METHOD

BACKGROUND OF THE INVENTION

The production of hydrocarbons often requires a borehole extending thousands of feet down into the earth, and that the hydrocarbons contained within a payzone be conducted into the borehole and up to the surface of the earth where the hydrocarbons are gathered. Most hydrocarbon producing wells require that a pumpjack be installed on the surface of the ground for reciprocating a string of sucker rod that extends downhole through the borehole to a downhole pump, so that the downhole pump lifts the formation fluid up through a tubing string to the surface of the earth. The downhole pump art is quite extensive and many clever engineers have spent a lifetime studying and working on downhole pumps of the type that are reciprocated by a pumpjack unit.

Various means for holding the pump apparatus downhole while the sucker rod string reciprocates part of the pump are known to those skilled in the art, and usually take the form of a seating nipple which is attached to the tubing string, and a pump hold-down which is sealingly supported in a removable manner in the seating nipple. Thus, the rod string can also be used to lift the pump hold-down from the seating nipple, thereby enabling repairs to be effected on the pump. It is well known that some pumps have a traveling barrel, while other pumps have a traveling plunger. There is no problem pulling a pump with the sucker rod string so long as it is not stuck downhole in the pump cavity or seating nipple. All that is required is time and money for the work-over rig and crew.

Some geological formations produce sand and other debris along with the production fluid. The sand and debris sometime become lodged between the seating nipple and the pump hold-down. When it comes time to pull the downhole pump, the sand and debris cause the pump to become stuck downhole, and the sucker rod string will break or part before it will lift the stuck downhole pump from the pump cavity of the borehole. A sucker rod string costs a lot of money, and can be ruined if it is overstressed and broken.

A stuck pump necessitates pulling the tubing string along with the rod string in order to replace the downhole pump. It is very expensive to pull the entire tubing string from a borehole, and in some instances where the tubing string is 8,000 to 10,000 feet long, the cost can amount to several thousand dollars. This is called "pulling a wet string", or a "stripping job", and is a detestable job for the roughnecks to endure, especially in the winter.

Many wells produce sour gas and salt water along with the crude oil. The pumps in these wells are stuck so often that they are almost always stripped of the rod string and tubing string whenever there is trouble with the downhole pump. The cost often causes the owner to shut-in a marginal well rather than endure the recurring cost of stripping the wet string several times a year.

The present invention provides method and apparatus by which a stuck downhole pump can be unseated and subsequently pulled from the borehole in a manner which avoids parting or over stressing the sucker rods, and which avoids the necessity of pulling the entire tubing string. This greatly reduces the cost of operation and allows a marginal well to be produced so that the hydrocarbons are made available to the public for many additional years.

The present invention is especially useful in conjunction with fiberglass sucker rod strings. Fiberglass rod strings are used predominantly where highly corrosive well fluids are encountered because the string is relatively inert and resists chemical reaction with the well fluids; however, the string has limited tensile properties and is easily parted. It follows that the present invention finds great utility in conjunction with a fiberglass rod string for a multitude of reasons, including the before mentioned ones, and others that will occur to those skilled in the art as this disclosure is more fully digested. This patent application is directed to one who is skilled in the art and such a person will understand the specifics of a downhole production pump, as for example an API RWTC type pump, API RWBC type pump, or a "tubing pump" of the type having a pump barrel incorporated as an integral part of the tubing string, with the pump plunger being lowered into the tubing on the bottom of the rod string. These production pumps are reciprocated by a rod string; and are provided with a hold-down of sorts which is received within a seating nipple of some arbitrary known design.

SUMMARY OF THE INVENTION

The present invention broadly relates to both method and apparatus for unsticking a downhole production pump from its seating cavity by pushing the pump in an uphole direction and thereby forcing the pump to become unseated from the seating cavity.

The present invention broadly sets forth both method and apparatus for unsticking a downhole production pump located at the lower end of a tubing string from its seating nipple by pushing the pump hold-down in an uphole direction and thereby forcing the pump to become unseated from the seating nipple. This enables the downhole pump to be easily removed from the borehole by pulling the pump with the sucker rod string after the pump is unstuck according to the teachings of the present invention.

In its more specific form, the present invention is used in a fluid producing well having a downhole pump assembly located at the lower end of a tubing string for producing fluid from a payzone wherein some parts of the pump are affixed to a hold-down means and the hold-down means is telescopingly received within a support means, as for example a seating nipple. The tubing string is supported at the surface of the earth by known means and lowered in a downhole direction in order to unstick the downhole pump. Means associated with the pump hold-down engage the borehole, as for example the bottom of the borehole, and thereby apply an uphole force or thrust on the hold-down which is equal to the amount of weight that is transferred from the surface equipment, into the tubing string, and into the wellbore. This action provides an upthrust on the hold-down which can be progressively increased to whatever value is required to force the pump to become unseated. The tubing string is then returned to its normal attached position at the wellhead, and the unstuck downhole pump can thereafter be easily pulled, for example by using the sucker rod string, thereby leaving the tubing string in the borehole and avoiding over stressing and parting of the sucker rod string.

More specifically, the present invention provides a combination with a downhole pump assembly of an apparatus by which the pump hold-down is pushed in an uphole direction and thereby forces the hold-down to become unseated from a seating nipple. The apparatus includes an adaptor located at the lower end of the pump hold-down that extends downhole away from the seating nipple. Means associated with the downhole equipment are connected to engage the borehole and apply an upward force on the adaptor in response to the tubing string being lowered downhole. This action unseats the hold-down from the seating nipple and moves the pump uphole respective to the tubing string, thereby unsticking the pump and allowing it to be retrieved from the wellbore without exceeding the structural integrity of the rod string.

The present invention also can be used to unstick a pump that has a broken rod string by fishing the part of the string that is connected to the pump and thereafter unsticking the pump in one of the above described manners.

A primary object of the present invention is the provision of a method of unsticking a downhole pump located at the bottom of a borehole by forcing the pump uphole in response to lowering the tubing string.

Another object of the present invention is the provision of apparatus by which a production pump located downhole in a borehole can be unstuck by lowering the tubing string, and consequently upthrusting the pump in response to the downward movement of the tubing string, thereby unsticking the downhole pump.

A further object of this invention is the provision of apparatus connected to a seating nipple and a pump hold-down by which downward movement of a tubing string causes upward movement of the pump hold-down thereby forcing the pump hold-down from the seating nipple.

A still further object of this invention is the provision of a telescoping apparatus having a lower marginal end for engaging the bottom of the borehole and an upper marginal end connected to a seating nipple; with a pump hold-down device having an extension adapted to abuttingly engage the lower marginal end of the telescoping apparatus and to thereby push the pump in an uphole direction respective to the seating nipple in response to downward movement of the tubing string.

An additional object of this invention is the provision of method and apparatus by which a downhole production pump can be unstuck by moving the pump uphole respective to the seating nipple from a location below the downhole pump.

Another and still further object of the invention is the provision of method and apparatus for removing a stuck downhole production pump from the lower end of a hydrocarbon producing borehole by lowering the tubing string downhole until a telescoping extension device encounters the borehole and pushes the pump uphole respective its seat in response to the downward movement of the tubing string.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

BRIEF DESCRIPTION OF THE DRAWINGS

FIG. 4 is a partly disassembled, part cross-sectional, longitudinal, broken, side elevational view of some of the apparatus disclosed in FIGS. 2 and 3;

FIG. 5 is a diagrammatical, part cross-sectional, broken, side elevational view that is representative of part of the apparatus disclosed in FIGS. 2–4;

FIG. 6 is a disassembled, part cross-sectional, side view showing some of the present invention in full lines and certain prior art apparatus is shown in dot-dash;

FIG. 7 is an enlarged, cross-sectional view taken along line 7—7 of FIG. 6;

FIG. 8 is an enlarged, cross-sectional view taken along line 8—8 of FIG. 6;

DETAILED DESCRIPTION OF THE PREFERRED EMBODIMENT

Figure 1:
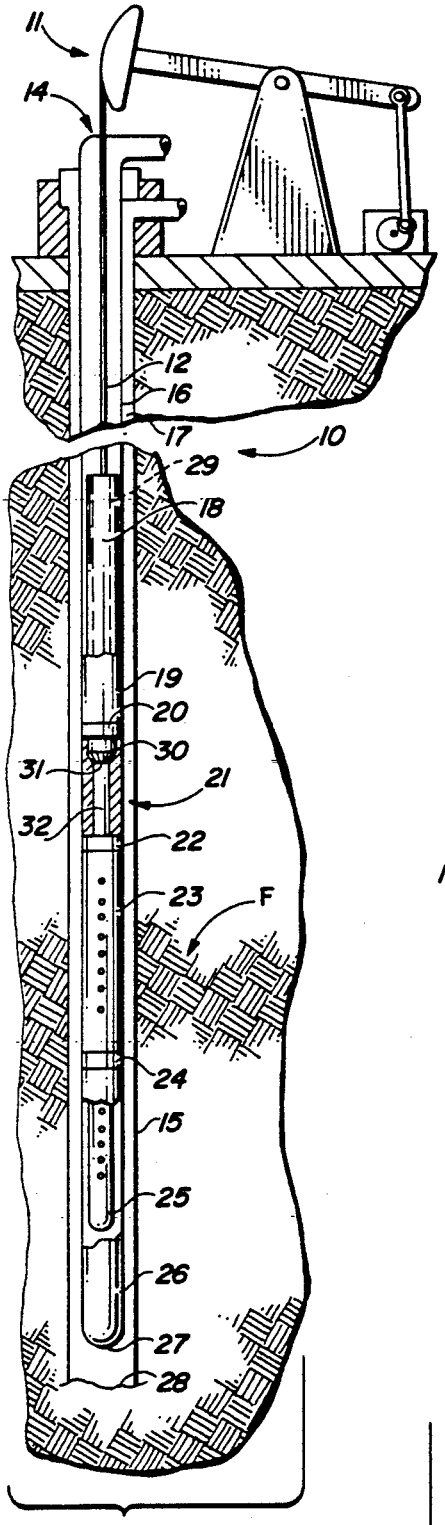
FIG. 1 (PRIOR ART)
FIG. 1 is a part diagrammatical, part schematical, part cross-sectional, side view of a section of the earth showing a prior art hydrocarbon producing apparatus.

FIG. 1 discloses a prior art oil well production system 10 having the usual pumpjack unit 11 supported above the surface of the ground for reciprocating the polished rod of a string 12 of sucker rod. The sucker rod string 12 extends downhole through a wellhead 14 and through a cased borehole 15. A production tubing string 16 is concentrically arranged within casing 15, leaving annulus 17 therebetween.

Deep, down within the borehole is a downhole production pump 18, that can take on any number of different forms, and particularly includes a pump device having a traveling barrel, or a pump device having a traveling plunger, as well as a pump device that can be entirely removed from the tubing string by manipulation of the sucker rod string in a manner known to those skilled in the art.

The last tubing joint 19 of the tubing string 16 is usually connected to a collar 20, which in turn is usually connected to an ordinary seating nipple 21. A collar 22 connects the seating nipple to a perforated joint 23. Collar 24 connects the perforated joint to a mud anchor 26 that terminates in a bull plug or the like at the lower terminal end 27. A gas anchor 25 has a hollow interior which is connected to the before mentioned pump 18 and communicates with the intake of the production pump by means of a pump hold-down. Numeral 28 indicates borehole structure, particularly the bottom of the borehole.

Comprehension of the elementary prior art hydrocarbon producing system set forth in FIG. 1 is essential for an understanding of the present invention. Those skilled in the art to which this patent application is directed fully comprehend all of the above prior art recitation and will therefore be able to fully comprehend and appreciate the following novel method and apparatus.

FIGS. 2 through 10 set forth method and apparatus by which a downhole production pump 18 can be unstuck by pushing the pump uphole from a location below the downhole pump. As particularly seen in FIGS. 2 and 3, together with other figures of the drawings, the pump has a plunger 29 which is reciprocated by the sucker rod 12. The plunger is shown as being reciprocatingly received within the barrel of a downhole pump 18 in the usual manner. The pump hold-down, generally indicated by numeral 32, includes the usual no-go 30 shown in the form of a circumferentially extending enlargement formed thereon which is made of a greater diameter than the seat 31 formed on the seating nipple 21. The pump hold-down 32 has the usual seals and opposed threaded ends formed thereon. The pump hold-down and seating nipple take on many different forms and are well known to those skilled in the art.

Figure 2:
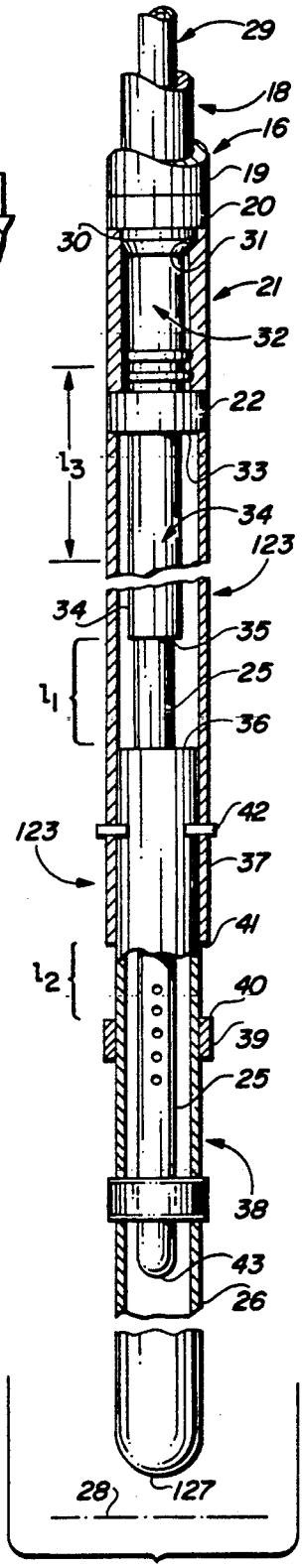
FIG. 2 is a longitudinal, part diagrammatical, part schematical, part cross-sectional, broken, side elevational representation of apparatus made in accordance with the present invention.

Numeral 33 indicates the lower end of the hold-down 32, while numeral 34 illustrates a novel adaptor, which preferably is in the form of a heavy, hollow, elongated, hexagon shaped bar that is threaded at one end thereof so as to be received by the lower end 33 of the pump hold-down 32; and, the adaptor 34 is threaded at the other end thereof for receiving the upper marginal terminal end of a prior art gas anchor 25. Accordingly, the assembly just described in conjunction with FIG. 2 is also seen on the left hand side of FIG. 4; and, commencing at the top of the left hand side of the FIG. 4, will be seen to include a sucker rod string 12, a pump barrel 18, a no-go 30, a hold-down 32, a lower end 33 of the hold-down, and a heavy, hollow, hexagon bar that forms an adaptor 34 having a lower terminal end 35 which is made in the form of a circumferentially extending shoulder. The shoulder forms an abutment for abuttingly engaging an upper annular seat or shoulder 36 of a novel telescoping sleeve assembly 123 for reasons that will become more apparent later on in this disclosure. The hollow, perforated gas anchor 25 preferably is affixed to the lower end of the adaptor extension 34, leaving the shoulder 35 confronting the shoulder 36 of the sleeve assembly 123.

The novel adaptor extension 34 of this invention is substituted for the usual prior art short, hollow, coupling having thread configurations at each opposed end thereof that normally connects the gas anchor to the lower end of the pump hold-down 32.

It is within the comprehension of this invention to fabricate the pump hold-down, extension 34, and gas anchor 25 in any number of different units that can be subdivided and thereby facilitate fabrication and assembly thereof.

Still looking at FIG. 4, together with other figures of the drawings, the apparatus on the right hand side, commencing with the last tubing joint 19, is seen to be connected to seating nipple 21 which in turn is connected to the novel telescoping sleeve assembly 123 which is comprised of an upper fixed tubing extension 37 arranged to telescopingly receive a lower marginal length of a slidable pump upthrust member 38 therewithin. The abutment 35 is therefore normally spaced from and confronts the abutment 36 formed at the upper terminal end of the slidable pump upthrust member 38, which is connected to a mud anchor 26.

Figure 3:
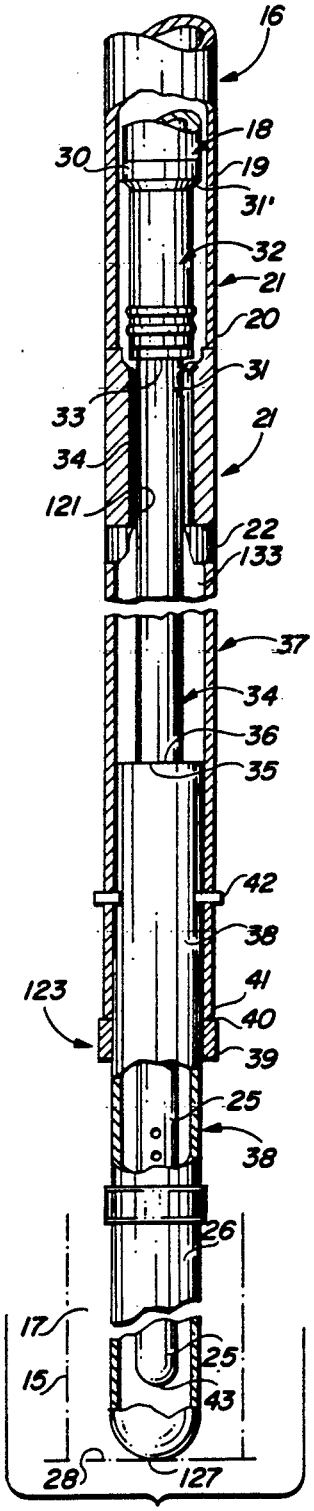
FIG. 3 is similar to FIG. 2 and shows the apparatus of FIG. 2 in an alternate configuration.

In FIGS. 2 and 3, collar 39 has an upper shoulder 40 formed thereon that abuttingly engages a lower shoulder 41 that forms the lower terminal end of the tubing extension that forms part of the sleeve assembly 123. A safety catch 42 limits downward motion of the telescoping upthrust member 38 of sleeve assembly 123 to prevent the lower marginal end of the sleeve assembly from separating from the upper marginal end thereof. As best seen in FIGS. 4 and 6, numeral 43 indicates the lower terminal end of the gas anchor which is spaced from the lower terminal end 127 of the mud anchor 26. Outlet ports 44 are formed into the upper marginal end of the fixed tubing extension of the telescoping member 123. These ports allow exit of fluid from tubing string 16 after the pump hold-down 32 is forced upward and out of the seating nipple 21. A product inlet port 145 of FIG. 9 serves as an inlet for well fluid to enter the member 38 at a location above the perforations of the gas anchor 25. In FIG. 6, an elongated slot 45 forms part of the safety catch 42.

As seen in FIG. 7, wrench flats 46 form the extension member or bar 34 into a hexagon configuration, although many other geometrical configurations can be used where wrench flats are not desired. Numeral 47 indicates a longitudinally extending axial passageway extending through the hollow, hexagon bar 34 for connecting the gas anchor 25 (FIGS. 2–4) to the pump hold-down at 32.

Figure 10:
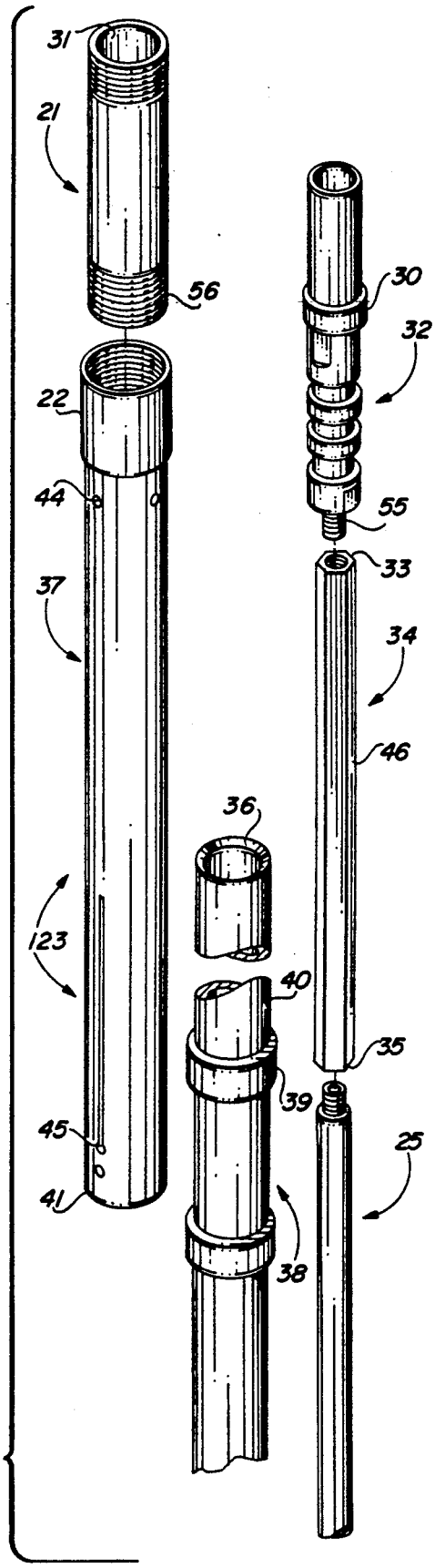

In FIGS. 6 and 8, a guide pin 48 is attached by head 49 to the upthrust member 38, with the pin extending through the before mentioned slot 45. Annulus 50 is formed between the gas anchor 25 and the upthrust member 38. Numeral 51 indicates in inner surface of the upthrust member 38 while numeral 52 indicates the inner surface of the fixed tubing extension and numeral 54 indicates the longitudinal axial passageway formed through the gas anchor 25. In FIG. 10, the threaded end of the pump hold-down is indicated by numeral 55 while numeral 33 indicates the upper threaded end of the adaptor 34.

Figure 9:
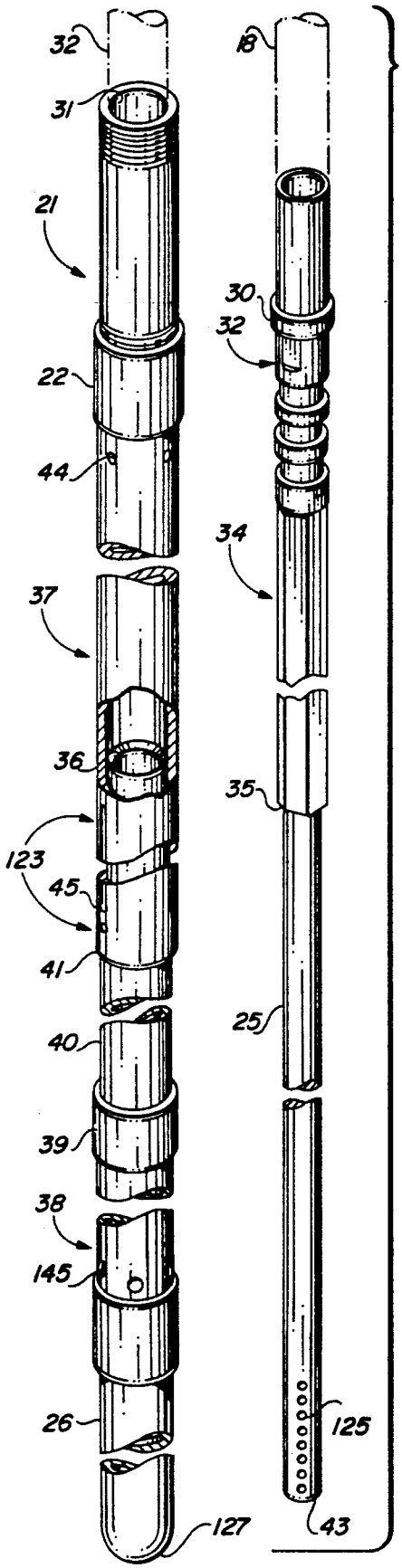
FIG. 9 is a broken, part cross-sectional, perspective view of apparatus made in accordance with the present invention; and, FIG. 10 is a further disassembled, elevational view of part of the apparatus disclosed in FIG. 9.

In operation, the apparatus of the present invention is made up in combination with any number of different downhole pumps of various designs, with the adaptor extension 34 being made into a suitable configuration for adapting or connecting the gas anchor to whatever hold-down 32 that may be used, with collar 22 of the fixed tubing extension 37 being made into a configuration that is readily adapted to the seating nipple 21 that may be selected for use in supporting the downhole pump 18. The apparatus on the left hand side of FIG. 9 is run downhole on the end of the tubing string and is properly positioned and supported within the borehole using prior art techniques. Next, the apparatus seen on the right hand side of FIG. 9 is run downhole on the end of the pump assembly, or part of the pump assembly that is attached to the rod string, and properly positioned in and through the seating nipple. In order to achieve this simple assembly of the combination disclosed herein, it is necessary that field personnel, skilled in the art, make certain that the abutment 35 located at the lower end of the adaptor 34 be properly spaced respective to the upper shoulder 36 of the pump upthrust support 38. Further, it is essential that the safety catch 42 be arranged with the pin 48 positioned near the lower extremity of slot 45. Moreover, stop member 39 must be properly spaced below shoulder 41 a sufficient distance that will not interfere with the operative engagement of annular shoulders 35 and 36. Those skilled in the art, having digested this disclosure, will appreciate that different hold-downs and seating nipples can advantageously be employed herein. The invention need not be limited for use in conjunction with a pump operated by a rod string for there are hydraulically actuated pumps of both the free and fixed types that can be used to great advantage in conjunction with the teachings of this invention. The best mode of operation is considered to be in conjunction with a downhole pump that is reciprocated by a rod string, and Applicant has reduced this embodiment of the invention to practice without having yet publicly disclosed his invention.

In the preferred embodiment of the invention as disclosed in FIGS. 9 and 10, adaptor 34 connects gas anchor 25 to whatever hold-down 32 may be used, with collar 22 of the fixed tubing extension 37 being made into a configuration that is readily adapted to the seating nipple 21 that may be used for supporting the hold-down of the downhole pump 18. This necessitates that the distances L1, L2, and L3 of FIG. 2 be carefully considered to assure that the relative operational range admit a proper range of travel of the components so that the final result provides a structure that enables the practice of the method of this invention.

With the apparatus of the present invention installed downhole in a borehole in combination with the downhole pump and other subsurface equipment, the time will eventually arrive when the downhole pump will become worn and will fail, and therefore must be retrieved for repair or replacement. At that time, an ordinary pulling unit will disengage the polish rod from the pumpjack horsehead and attempt to pull the pump or the appropriate parts of the pump 18 up through the tubing string by means of the sucker rod string 12. Often the pump will be stuck and the rod string can be injured when undue tension is placed thereon. At this time, according to this invention, it is necessary, as seen in FIG. 5, to latch onto the tubing string by means of clamping and lifting apparatus 46, which is supported at 1461, and to gently lower the tubing string downhole a few feet until the lowermost end 127 (FIGS. 2 and 3) of the mud anchor rests against the bottom 28 of the borehole, thereby pushing the pump upthrust member 38 uphole until shoulder 36 is brought into engagement with shoulder 35 at the terminal end of the adaptor 34; whereupon member 38 engages adaptor 34 and pushes the pump hold-down 32 uphole respective to the seating nipple 21. This new and novel method unsticks the pump in a patentable manner heretofore unknown and thereafter permits the pump to be safely pulled on at 245 by using the rod string 12. This action pushes the pump uphole respective to the fixed tubing extension 37 by means of the upthrust member 38 as a result of the annular shoulder or face 36 pushing uphole while in engagement with the terminal end 35 of adaptor 34. This action applies an upward force on the adaptor 34 which can be progressively increased to an enormous value that often is far in excess of the tensile strength of the rod string. The upthrust is progressively increased until it overcomes the force with which the pump is stuck in the pump cavity and thereby pushes the pump hold-down 32 uphole respective to the seating nipple 21, which unsticks the pump and thereafter permits the pump to be pulled by the rod string. Accordingly, the tubing is next reposition and reattached to the wellhead and thereafter the rod string can be used to pull the pump in a conventional and inexpensive manner now that the downhole pump has been unstuck and the only tension force left to contend with is the weight of the rod string and the pump.

A specific application of the present method and apparatus is as follows:

A 5,000 foot well has a 2 and ⅜ inch tubing string (4.7 lbs/ft) and a ¾ inch grade C rod string (tensile strength 28,000 lbs; weight 1.8 lb/ft) with a pump which is 2 inches by 1 and ¼ inches by 16 feet RHBC (API).

The pump is stuck and the pulling unit cannot unseat the pump without exceeding the tensile strength of the sucker rod string. It is assumed that the unseating apparatus of the present invention has previously been placed in operative position downhole in the borehole in combination with the other necessary subsurface equipment.

The rod string weighs 9,000 lbs. ($5000\times1.8$). The hydrostatic load on the effective cross-sectional area of the pump hold-down is 6494 lbs. (the cross-sectional area of the hold-down is 2.4052 sq. in.). The pressure gradient of the tubing fluid is 0.54 psi/ft. The pressure on the seating nipple is 2700 psi. ($2700\times2.4052=6494$ lbs.). These figures are approximate. Friction hold-down of the seating nipple on the hold-down of the pump requires 1000 pounds pull to be overcome. Friction between rods and tubing as the rods are pulled uphole is estimated to be 1000 pounds, assuming no paraffin build up. Accordingly, the pulling unit must pull the following: rod weight 9000 lbs., hydrostatic load 6494 lbs., seating nipple friction 1000 lbs., rod/tubing friction 1000 lbs. Therefore, the total pulling force required for release of the pump is 17,494 lbs. of upward pull, which also is the required rod tension. However, the pump has accumulated scale, sand, and other debris causing the pump to bind and to become stuck in its seat. The maximum allowable rod pull is exerted by the pulling unit; however, the pump does not move and any additional force will stretch the rod string and continued stress will cause the string to part. Under these conditions the pump cannot be pulled from the pump cavity, but with the present invention it is possible to push the pump uphole with an available force of enormous magnitude.

The weight of the tubing is 25,180 lbs. Added to this is the weight of the fluid not acting as a hydrostatic head on the cross-sectional area of the pump. Lowering the tubing and lifting or pushing the pump hold-down uphole in accordance with the present invention makes available more than 25,180 lbs. acting as an upward force on the stuck pump before any tension is exerted on the rod string. The usable or actual upward pull on the pump by pulling the maximum allowable pull on the top rod is about 10,000 lbs. (maximum rod tension of 28,000 lbs. minus resisting loads of 17,494 lbs.). Therefore, more than 35,180 lbs. of force are now available to act directly to move the pump uphole respective to the seating nipple to thereby achieve unseating of the stuck pump in an unexpected, new, different, and heretofore unknown manner.

The present invention is intended to be used with pumps which are built as a unit; that is, barrel, plunger and hold-down are run together on the rod and inserted into the seating nipple. The present invention is easily adapted to a downhole pump where the barrel is run as part of the string and only the plunger is run on the rod. The present invention further is advantageously used where the plunger is lowered to catch the standing valve/hold-down assembly.

The present invention provides method and apparatus that can advantageously be used for any downhole pump that incorporates some form of seating nipple and some form of pump hold-down where the pump hold-down or the seating nipple or other parts of the pump are liable to cause the pump to get stuck downhole in a borehole.

I claim:

1. In a fluid producing borehole having a downhole pump assembly located at a lower end of a tubing string for producing fluid from a pay zone, wherein some parts of the pump assembly are affixed to a hold-down and the hold-down is telescopingly received in sealed relationship within a seating nipple, the combination with said pump assembly of an apparatus for unsticking a downhole pump assembly by pushing the hold-down in an uphole direction and thereby forcing the hold-down to become unseated from the seating nipple;

said apparatus includes a pump upthrust member affixed at the lower end of said hold-down and extending downhole away from said seating nipple;

means connected to engage the borehole and apply an up-hole force on said pump upthrust member in response to the tubing string being lowered downhole; and thereby unseat the hold-down from the seating nipple, and move the pump uphole respective to the tubing string, whereupon the downhole pump can then be retrieved from the borehole.

2. The combination of claim 1 wherein said means connected to engage the borehole is a telescoping sleeve assembly having a longitudinally extending axial passageway along which formation fluid can flow towards the pump; said sleeve assembly has a marginal length in the form of a fixed tubing extension that is affixed to the seating nipple and said pump upthrust member forms another marginal length that telescope uphole respective to said fixed tubing extension and thereby forces said hold-down uphole respective to the seating nipple in response to the tubing string being lowered sufficiently to engage the borehole structure and thereby transfer the tubing weight onto the telescopingly sleeve assembly and thereby employ the tubing weight for pushing the hold-down in an uphole direction in order to unstick a downhole pump.

3. The combination of claim 1 wherein said means connected to engage the borehole is a telescoping sleeve assembly having a longitudinally extending axial passageway along which formation fluid can flow towards the pump; said sleeve assembly has a fixed tubing extension that forms an upper marginal length thereof that is connected to the seating nipple and a lower marginal length that is formed by said pump upthrust member and is slidably received respective to the upper marginal length of the telescoping sleeve assembly and telescopes uphole respective thereto; means on said lower marginal length for engaging and forcing said hold-down uphole respective to the seating nipple in response to the tubing being lowered sufficiently to engage the borehole with the lower marginal length of said telescoping sleeve assembly and thereby transfer at least part of the tubing weight onto the telescopingly lower marginal length which in turn engages and forces the hold-down to move uphole respective to the seating nipple to thereby employ the tubing weight for pushing the hold-down in an uphole direction and thus the pump uphole in order to unstick a downhole pump that is stuck downhole in a borehole.

4. The combination of claim 1 wherein said hold-down is connected to an extension, said means connected to engage the borehole is said pump upthrust member which is connected to telescope into engagement with said extension and having a longitudinally extending axial passageway along which formation fluid can flow towards the pump; said extension is received within a fixed tubing extension which is connected to the seating nipple and further has a marginal length that slidably receives said pump upthrust member and engages the borehole and thereby forces said hold-down uphole respective to the seating nipple in response to the tubing being lowered sufficiently to engage the borehole and transfer the tubing weight onto the lower marginal length of the upthrust member whereby the tubing weight can be used for pushing the hold-down uphole in order to unstick a downhole pump.

5. The combination of claim 1 wherein said means for engaging said hold-down is an adaptor which is hollow and can be connected to receive flow from a gas anchor;

said means connected to engage the borehole is a telescoping sleeve assembly having a longitudinally extending axial passageway along which formation fluid can flow towards the pump; said sleeve assembly has a first marginal length affixed to the seating nipple and a second marginal length that telescopes uphole to engage and force said adaptor to move said hold-down uphole respective to the seating nipple in response to the tubing being lowered sufficiently to engage the borehole and transfer the tubing weight onto the telescopingly marginal length and thereby employ the tubing weight for pushing the hold-down uphole in order to unstick a downhole pump.

6. In a fluid producing borehole having a downhole pump assembly located at a lower end of a tubing string for producing fluid from a pay zone, some parts of the pump is affixed to a hold-down and the hold-down is telescopingly received in a removable manner in sealed relationship within a seating nipple, the improvement comprising;

apparatus by which the pump assembly can be pushed in an uphole direction respective to the seating nipple and thereby become unseated from the seating nipple in response to transferring the weight of the tubing into an upward force that acts on said pump hold-down;

said apparatus includes an extension located at the lower end of said hold-down, said extension extends downhole and terminates in spaced relationship respective to a lower end of said seating nipple;

said apparatus further includes means connected to engage the borehole and apply an uphole force on said extension in response to the tubing string being lowered downhole; and thereby unseat the hold-down from the seating nipple and facilitate retrieving the pump from the borehole.

7. The improvement of claim 6 wherein said extension is hollow and can be connected to receive flow from a gas anchor;

said means connected to engage the borehole is a telescoping sleeve assembly having a longitudinally extending axial passageway along which formation fluid can flow towards the pump; said sleeve assembly has an upper marginal length affixed to the seating nipple and a lower marginal length that telescopes uphole respective to the upper marginal length and forces said extension to move said hold-down in an uphole direction respective to the seating nipple in response to the tubing being lowered sufficiently to engage the borehole and transfer the tubing weight onto the telescoping marginal length and thereby employ the tubing weight for pushing the hold-down uphole in order to unstick a downhole pump.

8. The improvement of claim 6 wherein said means connected to engage the borehole includes a telescoping sleeve assembly having a longitudinally extending axial passageway along which formation fluid can flow towards the pump; said sleeve assembly has a marginal length affixed to the seating nipple and a marginal length that telescopes uphole and forces said hold-down uphole respective to the seating nipple in response to the tubing being lowered sufficiently to engage the borehole and transfer the tubing weight onto the telescopingly marginal length and thereby employ the tubing weight for pushing the hold-down uphole in order to unstick a downhole pump.

9. The improvement of claim 6 wherein said means connected to engage the borehole is in the form of a telescoping member having a longitudinally extending axial passageway along which formation fluid can flow towards the pump; said telescoping member has an upper marginal length connected to the seating nipple and a lower marginal length that is slidably received respective to the upper marginal length and telescopes uphole respective thereto; means on said lower marginal length for engaging and forcing said hold-down uphole respective to the seating nipple in response to the tubing being lowered sufficiently to engage the borehole with the lower marginal length and thereby transfer at least part of the tubing weight onto the telescopingly lower marginal length which in turn engages and forces the hold-down to move uphole respective to the seating nipple to thereby employ the tubing weight for pushing the hold-down and thus the pump uphole in order to unstick a downhole pump that is stuck downhole in a borehole.

10. The improvement of claim 6 wherein said means connected to engage the borehole includes an extension having a longitudinally extending axial passageway along which formation fluid can flow towards the pump; said extension has a marginal length adapted to engage the seating nipple and a marginal length that engages the borehole and thereby forces said hold-down uphole respective to the seating nipple in response to the tubing being lowered sufficiently to engage the borehole and transfer the tubing weight onto the lower marginal length whereby the tubing weight can be used for pushing the hold-down uphole in order to unstick part of a downhole pump.

11. In a fluid producing borehole having a downhole pump assembly located at a lower end of a tubing string for producing fluid from a pay zone, wherein some parts of the pump is affixed to a hold-down and the hold-down is telescopingly received in sealed relationship within a seating nipple, the method of forcing the pump hold-down to become unseated from the seating nipple, comprising the steps of;

extending the lower end of said hold-down in a downhole direction away from said seating nipple;

engaging the extended lower end of said hold-down with the borehole by lowering the tubing string in a downhole direction;

moving the pump uphole respective to the seating nipple by applying an uphole force on the extended lower end of said hold-down in response to the tubing being lowered downhole and thereby unseat the hold-down from the seating nipple.

12. The method of claim 11 and further including the steps of:

extending the lower end of said hold-down into engagement with the bottom of the borehole by connecting a telescoping sleeve assembly at the lower end of the hold-down and seating nipple; forming a longitudinally extending axial passageway through said sleeve assembly along which formation fluid can flow towards an intake of the pump; affixing a marginal length of said sleeve assembly to the seating nipple, and slidably connecting another marginal length of the sleeve assembly that telescope uphole and forces said hold-down in an uphole direction respective to the seating nipple in response to the tubing being lowered sufficiently to engage the borehole and transfer the tubing weight onto the telescopingly marginal length and thereby employ the tubing weight for pushing the hold-down uphole in order to unstick a downhole pump.

13. The method of claim 11 and further including the steps of:

forming said extended lower end of said hold-down into a telescoping sleeve assembly and forming a longitudinally extending axial passageway through said sleeve assembly along which formation fluid can flow towards the pump; connecting an upper marginal length of said sleeve assembly to the seating nipple with a lower marginal length thereof being slidably received respective to the upper marginal length and whereby the lower marginal length telescopes uphole respective to the upper marginal length;

engaging and forcing said hold-down in an uphole direction respective to the seating nipple in response to the tubing being lowered sufficiently to engage the borehole with said lower marginal length and thereby transfer at least part of the tubing weight onto the telescoping lower marginal length which in turn engages and forces the hold-down to move uphole respective to the seating nipple to thereby employ the tubing weight for pushing the hold-down upwardly and thus the pump uphole in order to unstick a downhole pump that is stuck downhole in a borehole.

14. In a fluid producing borehole having a downhole pump assembly located at a lower end of a tubing string for producing fluid from a pay zone located downhole in the borehole, wherein some parts of the pump assembly is affixed to lower end of the tubing string and some parts of the pump assembly are removably supported in sealed relationship within the lower end of the tubing string, the method of forcing the removably supported pump parts to become unseated from the tubing string, comprising the steps of:

extending the lower end of said parts of the pump assembly that are removably supported in a downhole direction away from the remaining parts of said pump assembly;

forcing the removably supported parts of the pump assembly to move uphole respective to the tubing string by applying an uphole force on the extended lower end in response to the tubing being lowered downhole while engaging the borehole with said extended lower end and thereby unseat the removably supported parts of the pump assembly from the lower end of the tubing.

15. The method of claim 14 wherein a hold-down is included in some of the parts of the pump assembly that are removably supported; extending the lower end of said hold-down into engagement with the bottom of the borehole by arranging a telescoping sleeve assembly having a longitudinally extending axial passageway along which formation fluid can flow towards the pump assembly; affixing a marginal length of said sleeve assembly to a lower end of the tubing and connecting a marginal length that telescopes uphole to force said hold-down uphole respective to the lower end of the tubing in response to the tubing being lowered sufficiently to engage the borehole and transfer the tubing weight onto the telescoping marginal length and thereby employ the tubing weight for pushing the hold-down uphole in order to unstick a downhole pump assembly.

16. The method of claim 14 and further including the steps of forming said parts of the pump assembly that are removably supported into a telescoping sleeve assembly; connecting an upper marginal length of said sleeve assembly to the lower end of the tubing and arranging a lower marginal length of the sleeve assembly for being slidably received respective to the upper marginal length and thereby telescopes uphole respective thereto;

engaging and forcing said lower marginal length of said sleeve assembly uphole respective to the upper marginal length thereof in response to the tubing being lowered sufficiently to engage the borehole with the lower marginal length and thereby transfer at least part of the tubing weight onto the telecoping lower marginal length which in turn engages and forces the parts of the pump assembly that are removably supported to move uphole respective to the lower end of the tubing to thereby employ the tubing weight for pushing the pump uphole in order to unstick a downhole pump assembly that is stuck downhole in a borehole.

17. In a borehole having a downhole pump assembly located at a lower end of a tubing string for producing fluid from a pay zone; a pump hold-down, a seating nipple, part of the pump assembly being affixed to said pump hold-down and the hold-down is removably received within said seating nipple, the combination with said pump assembly, seating nipple, and hold-down of an apparatus for unsticking the hold-down from the seating nipple by pushing the hold-down in an uphole direction and thereby forcing the hold-down to become unseated from the seating nipple;

said apparatus includes an upthrust member affixed at the lower end of said hold-down and extending downhole from said seating nipple; said upthrust member includes means connected to engage the borehole to apply an up-hole force in response to the tubing string being lowered downhole;

whereby, the tubing string can be lowered by manipulating the string from the upper end of the borehole to force the hold-down in an uphole direction respective to the seating nipple and unseat the hold-down from the seating nipple, and thereby enable part of the pump that is affixed to the hold-down to be moved uphole respective to the tubing string, whereupon the down-hole pump can be retrieved from the tubing string.

18. The combination of claim 17 wherein said means connected to engage the borehole is a telescoping sleeve assembly having a longitudinally extending axial passageway along which formation fluid can flow towards the pump; said sleeve assembly has a marginal length in the form of a fixed tubing extension that is affixed to the seating nipple and said pump upthrust member forms another marginal length that telescopes uphole respective to said fixed tubing extension and thereby forces said hold-down uphole respective to the seating nipple in response to the tubing string being lowered sufficiently to engage the borehole structure and to transfer the tubing weight onto the telescoping sleeve assembly whereupon the tubing weight can be used for pushing the hold-down in an uphole direction in order to unstick a downhole pump.

19. The combination of claim 17 wherein saids means connected to engage the borehole is a telescoping sleeve assembly having a longitudinally extending axial passageway along which formation fluid can flow towards the pump; said sleeve assembly has a fixed tubing extension that forms an upper marginal length thereof that is connected to the seating nipple and a lower marginal length that is formed by said pump upthrust member and is slidably received respective to the upper marginal length of the telescoping sleeve assembly and telescopes uphole respective thereto; means on said lower marginal length for engaging and forcing said hold-down uphole respective to the seating nipple in response to the tubing being lowered sufficiently to engage the borehole with the lower marginal length of said telescoping sleeve assembly and thereby transfer at least part of the tubing weight onto the telescopingly lower marginal length which in turn engages and forces the hold-down to move uphole respective to the seating nipple to thereby employ the tubing weight for pushing the hold-down in an uphole direction and thus the pump uphole in order to unstick a downhole pump that is stuck downhole in a borehole.

20. The combination of claim 17 wherein said hold-down is connected to an extension, said means connected to engage the borehole is said pump upthrust member which is connected to telescope into engagement with said extension and having a longitudinally extending axial passageway along which formation fluid can flow towards the pump; said extension is received within a fixed tubing extension which is connected to the seating nipple and further has a marginal length that slidably receives said pump upthrust member and engages the borehole and thereby forces said hold-down uphole respective to the seating nipple in response to the tubing being lowered sufficiently to engage the borehole and transfer the tubing weight onto the lower marginal length of the upthrust member whereby the tubing weight can be used for pushing the hold-down uphole in order to unstick a downhole pump.

* * * * *